US010465329B2

(12) United States Patent
Basheer

(10) Patent No.: US 10,465,329 B2
(45) Date of Patent: Nov. 5, 2019

(54) LAUNDRY TREATING APPLIANCE WITH HELICAL DRIVE MECHANISM

(71) Applicant: WHIRLPOOL CORPORATION, Benton Harbor, MI (US)

(72) Inventor: Mohamed Basheer, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 180 days.

(21) Appl. No.: 15/637,223

(22) Filed: Jun. 29, 2017

(65) Prior Publication Data

US 2018/0105970 A1 Apr. 19, 2018

Related U.S. Application Data

(60) Provisional application No. 62/408,111, filed on Oct. 14, 2016.

(51) Int. Cl.

| | |
|---|---|
| ***A47L 15/00*** | (2006.01) |
| ***A47L 15/42*** | (2006.01) |
| ***A47L 15/44*** | (2006.01) |
| ***D06F 33/02*** | (2006.01) |
| ***D06F 37/40*** | (2006.01) |

(Continued)

(52) U.S. Cl.

CPC ..... *D06F 39/14* (2013.01); *A47L 15/4214* (2013.01); *A47L 15/44* (2013.01); *D06F 37/40* (2013.01); *D06F 39/022* (2013.01); *D06F 39/028* (2013.01); *D06F 39/08* (2013.01); *A47L 15/00* (2013.01); *D06F 33/02* (2013.01); *D06F 39/00* (2013.01); *D06F 2202/04* (2013.01);

(Continued)

(58) Field of Classification Search

CPC ..... A47L 15/00; A47L 15/4214; A47L 15/44; D06F 33/02; D06F 37/40; D06F 39/00; D06F 39/022; D06F 39/028; D06F 39/08; D06F 39/14; D06F 2202/04; D06F 2202/065; D06F 2204/088

USPC ..... 68/12.05, 23.7

See application file for complete search history.

(56) References Cited

U.S. PATENT DOCUMENTS

| | | | | |
|---|---|---|---|---|
| 6,077,184 | A | 6/2000 | Lee | |
| 2012/0304704 | A1* | 12/2012 | Ponnaganti | D06F 37/40 68/140 |

(Continued)

FOREIGN PATENT DOCUMENTS

| | | |
|---|---|---|
| CN | 204921861 U | 12/2015 |
| JP | 01270896 A | 10/1989 |

(Continued)

*Primary Examiner* — Levon J Shahinian

(74) *Attorney, Agent, or Firm* — McGarry Bair PC

(57) ABSTRACT

A laundry treating appliance includes a tub defining an interior, a basket with a spin tube located within the interior and rotatably mounted within the tub, a motor having a first drive shaft, a clothes mover rotatably mounted within the basket and having a second drive shaft, and a clutch having a helical drive mechanism including a helical sun gear driven by the first drive shaft, at least one helical planet gear driven by the helical sun gear, a planet carrier driven by the at least one helical planet gear, the planet carrier selectively coupled to the second drive shaft to rotate the clothes mover, and an outer helical ring gear driven by the at least one helical planet gear, the outer helical ring gear operably coupled to the spin tube to rotate the basket.

20 Claims, 11 Drawing Sheets

(51) Int. Cl.

| | |
|---|---|
| ***D06F 39/00*** | (2006.01) |
| ***D06F 39/02*** | (2006.01) |
| ***D06F 39/08*** | (2006.01) |
| ***D06F 39/14*** | (2006.01) |

(52) U.S. Cl.
CPC .. *D06F 2202/065* (2013.01); *D06F 2204/088* (2013.01)

(56) References Cited

U.S. PATENT DOCUMENTS

2014/0101864 A1* 4/2014 Lee ..... D06F 33/02 8/137
2014/0318574 A1* 10/2014 Safavi ..... A47L 15/4242 134/1

FOREIGN PATENT DOCUMENTS

JP 3080896 A 4/1991
JP 4186358 B2 11/2008

* cited by examiner

LAUNDRY TREATING APPLIANCE WITH HELICAL DRIVE MECHANISM

CROSS-REFERENCE TO RELATED APPLICATIONS

This application claims priority to U.S. Provisional Patent Application No. 62/408,111, filed on Oct. 14, 2016, the entirety of which is incorporated herein by reference.

BACKGROUND OF THE INVENTION

Laundry treating appliances, such as washing machines, refreshers, and non-aqueous systems, can have a configuration based on a rotating container that at least partially defines a treating chamber in which laundry items are placed for treating. The laundry treating appliance may have a controller that implements a number of user-selectable, pre-programmed cycles of operation. Hot water, cold water, or a mixture thereof along with various treating chemistries may be supplied to the treating chamber in accordance with the cycle of operation.

Washing machines having a motor that drives the clothes mover as well as the basket require a drive system to transmit rotational movement from the motor to the clothes mover and the basket, selectively. Such a drive system can translate movement of the motor to the appropriate rotational speed of the clothes mover and the basket via a drive shaft and a drive mechanism that can include a plurality of gears operably coupled to a drive shaft.

BRIEF SUMMARY OF THE INVENTION

In one aspect, illustrative embodiments in accordance with the present disclosure relate to a laundry treating appliance including a tub defining an interior, a basket with a spin tube located within the interior and rotatably mounted within the tub, a motor having a first drive shaft, a clothes mover rotatably mounted within the basket and having a second drive shaft, and a clutch having a helical drive mechanism including a helical sun gear driven by the first drive shaft, at least one helical planet gear driven by the helical sun gear, a planet carrier driven by the at least one helical planet gear, the planet carrier selectively coupled to the second drive shaft to rotate the clothes mover, and an outer helical ring gear driven by the at least one helical planet gear, the outer helical ring gear operably coupled to the spin tube to rotate the basket, wherein meshes formed by teeth between the helical sun gear, the at least one helical planet gear, or the helical ring gear have differing mesh phasing.

In another aspect, illustrative embodiments in accordance with the present disclosure relate to a laundry treating appliance including a tub defining an interior, a basket with a spin tube located within the interior and rotatably mounted within the tub, a motor having a first drive shaft, a clothes mover rotatably mounted within the basket and having a second drive shaft, and a clutch having a helical drive mechanism including a helical sun gear driven by the first drive shaft, at least one helical planet gear driven by the helical sun gear, a planet carrier driven by the at least one helical planet gear, the planet carrier selectively coupled to the second drive shaft to rotate the clothes mover, and an outer helical ring gear driven by the at least one helical planet gear, the outer helical ring gear operably coupled to the spin tube to rotate the basket, wherein meshes formed by teeth between one of the helical sun gear, helical planet gears, or helical ring gear define a total contact ratio greater than 3:1.

DETAILED DESCRIPTION OF EMBODIMENTS OF THE INVENTION

Illustrative washing machines in accordance with the present disclosure include a rotatable clothes mover and a rotatable basket. Clothes movers generally oscillate, or rotate back and forth in accordance with a stroke angle, to provide agitation to a laundry load during washing operations. Clothes movers and rotatable baskets generally spin together during spin cycle operations. To enable both of these functionalities, including oscillation by the clothes mover and joint spinning by the clothes mover and basket, a common drive system can be included. Such a drive system can include a drive mechanism for translating movement from the motor into rotational movement of the basket and clothes mover by the use of a drive shaft that is operably coupled to a series of gears.

Traditional drive mechanisms can include the use of a sun gear, a set of planetary gears, and an external ring gear. The planetary gears are often provided as spur gears. However, the use of spur gears can result in noises during operation that can be unpleasant to a user. Drive mechanisms in accordance with the present disclosure enable the use of helical gears in place of conventional spur gears in the drive mechanism. The use of helical planetary gears, specifically with selected gear contact ratios, can reduce noises during the operation of the washing machine. Noise of operation of the washing machine can be further reduced with the use of washers in such a helical drive mechanism that are formed from a specialized material in accordance with the present disclosure.

Figure 1:
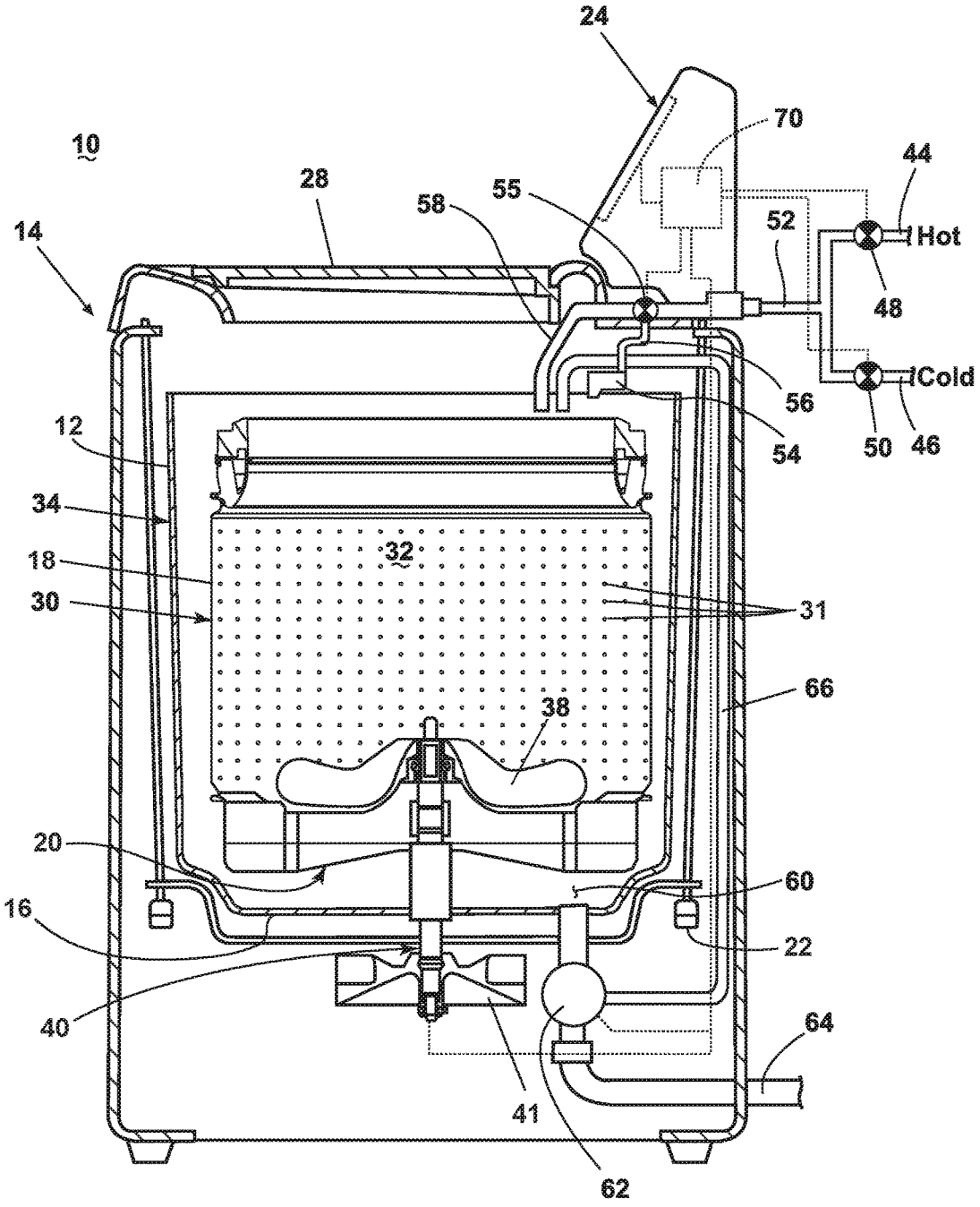
FIG. 1 illustrates a schematic cross-sectional view of a laundry treating appliance in the form of a washing machine according to an embodiment of the present disclosure.

FIG. 1 illustrates a schematic cross-sectional view of a laundry treating appliance shown in the form of a washing machine 10 according to one embodiment of the present disclosure. While the laundry treating appliance is illustrated as a vertical axis, top-fill washing machine, the embodiments of the present disclosure can have applicability in other fabric treating appliances, non-limiting examples of which include a combination washing machine and dryer, a refreshing/revitalizing machine, an extractor, or a non-aqueous washing apparatus.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles. The illustrated exemplary washing machine of FIG. 1 is a vertical axis washing machine.

The washing machine 10 can include a structural support system comprising a cabinet 14 that defines a housing, within which a laundry holding system resides. The cabinet 14 can be a housing having a chassis and/or a frame defining an interior that receives components typically found in a conventional washing machine, such as motors, pumps, fluid lines, controls, sensors, transducers, and the like. Such components will not be described further herein except as necessary for a complete understanding of the present disclosure. The top of the cabinet 14 can include a selectively openable lid 28 to provide access into the laundry treating chamber 32 through an open top of the basket 30.

The fabric holding system of the illustrated exemplary washing machine 10 can include a rotatable basket 30 having an open top that can be disposed within the interior of the cabinet 14 and may define a treating chamber 32 for receiving laundry items for treatment. A tub 34 can also be positioned within the cabinet 14 and can define an interior within which the basket 30 can be positioned. The tub 34 can have a generally cylindrical side or tub peripheral wall 12 closed at its bottom end by a base 16 that can at least partially define a sump 60.

The basket 30 can have a generally peripheral side wall 18, which is illustrated as a cylindrical side wall, closed at the basket end by a basket base 20 to at least partially define the treating chamber 32. The basket 30 can be rotatably mounted within the tub 34 for rotation about a vertical basket axis of rotation and can include a plurality of perforations 31, such that liquid may flow between the tub 34 and the rotatable basket 30 through the perforations 31. While the illustrated washing machine 10 includes both the tub 34 and the basket 30, with the basket 30 defining the treating chamber 32, it is within the scope of the present disclosure for the laundry treating appliance to include only one receptacle, with the receptacle defining the laundry treatment chamber for receiving the load to be treated.

A clothes mover 38 may be rotatably mounted within the basket 30 to impart mechanical agitation to a load of laundry placed in the basket 30. The clothes mover 38 can be oscillated or rotated about its axis of rotation during a cycle of operation in order to produce load motion effective to wash the load contained within the treating chamber 32. Other exemplary types of laundry movers include, but are not limited to, an agitator, a wobble plate, and a hybrid impeller/agitator.

The basket 30 and the clothes mover 38 may be driven by a drive system 40 that includes a motor 41, which can include a gear case, operably coupled with the basket 30 and clothes mover 38. The motor 41 can rotate the basket 30 at various speeds in either rotational direction about the vertical axis of rotation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch can be included in the drive system 40 and can selectively operably couple the motor 41 with either the basket 30 and/or the clothes mover 38.

A suspension system 22 can dynamically hold the tub 34 within the cabinet 14. The suspension system 22 can dissipate a determined degree of vibratory energy generated by the rotation of the basket 30 and/or the clothes mover 38 during a treating cycle of operation. Together, the tub 34, the basket 30, and any contents of the basket 30, such as liquid and laundry items, define a suspended mass for the suspension system 22.

A liquid supply system can be provided to liquid, such as water or a combination of water and one or more wash aids, such as detergent, into the treating chamber 32. The liquid supply system can include a water supply configured to supply hot or cold water. The water supply can include a hot water inlet 44 and a cold water inlet 46, a valve assembly, which can include a hot water valve 48, a cold water valve 50, and a diverter valve 55, and various conduits 52, 56, 58. The valves 48, 50 are selectively openable to provide water, such as from a household water supply (not shown) to the conduit 52. The valves 48, 50 can be opened individually or together to provide a mix of hot and cold water at a selected temperature. While the valves 48, 50 and conduit 52 are illustrated exteriorly of the cabinet 14, it may be understood that these components can be internal to the housing.

As illustrated, a detergent dispenser 54 can be fluidly coupled with the conduit 52 through a diverter valve 55 and a first water conduit 56. The detergent dispenser 54 can include means for supplying or mixing detergent to or with water from the first water conduit 56 and can supply such treating liquid to the tub 34. It has been contemplated that water from the first water conduit 56 can also be supplied to the tub 34 through the detergent dispenser 54 without the addition of a detergent. A second water conduit, illustrated as a separate water inlet 58, can also be fluidly coupled with the conduit 52 through the diverter valve 55 such that water can be supplied directly to the treating chamber through the open top of the basket 30. Additionally, the liquid supply system can differ from the configuration shown, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid.

A liquid recirculation system can be provided for recirculating liquid from the tub 34 into the treating chamber 32. More specifically, a sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. The liquid recirculation system can include other types of recirculation systems.

It is noted that the illustrated drive system, suspension system, liquid supply system, and recirculation and drain system are shown for exemplary purposes only and are not limited to the systems shown in the drawings and described above. For example, the liquid supply, recirculation, and pump systems can differ from the configuration shown in FIG. 1, such as by inclusion of other valves, conduits, treating chemistry dispensers, sensors (such as liquid level sensors and temperature sensors), and the like, to control the flow of liquid through the washing machine 10 and for the introduction of more than one type of treating chemistry. For example, the liquid supply system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump. Alternatively, the heating system can be in the form of an in-line heater that heats the liquid as it flows through the liquid supply, dispensing and/or recirculation systems.

The washing machine 10 can further include a controller 70 coupled with various working components of the washing machine 10 to control the operation of the working components and to implement one or more treating cycles of operation. The control system can further include a user interface 24 that is operably coupled with the controller 70. The user interface 24 can include one or more knobs, dials, switches, displays, touch screens and the like for communicating with the user, such as to receive input and provide output. The user can enter different types of information including, without limitation, cycle selection and cycle parameters, such as cycle options.

The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
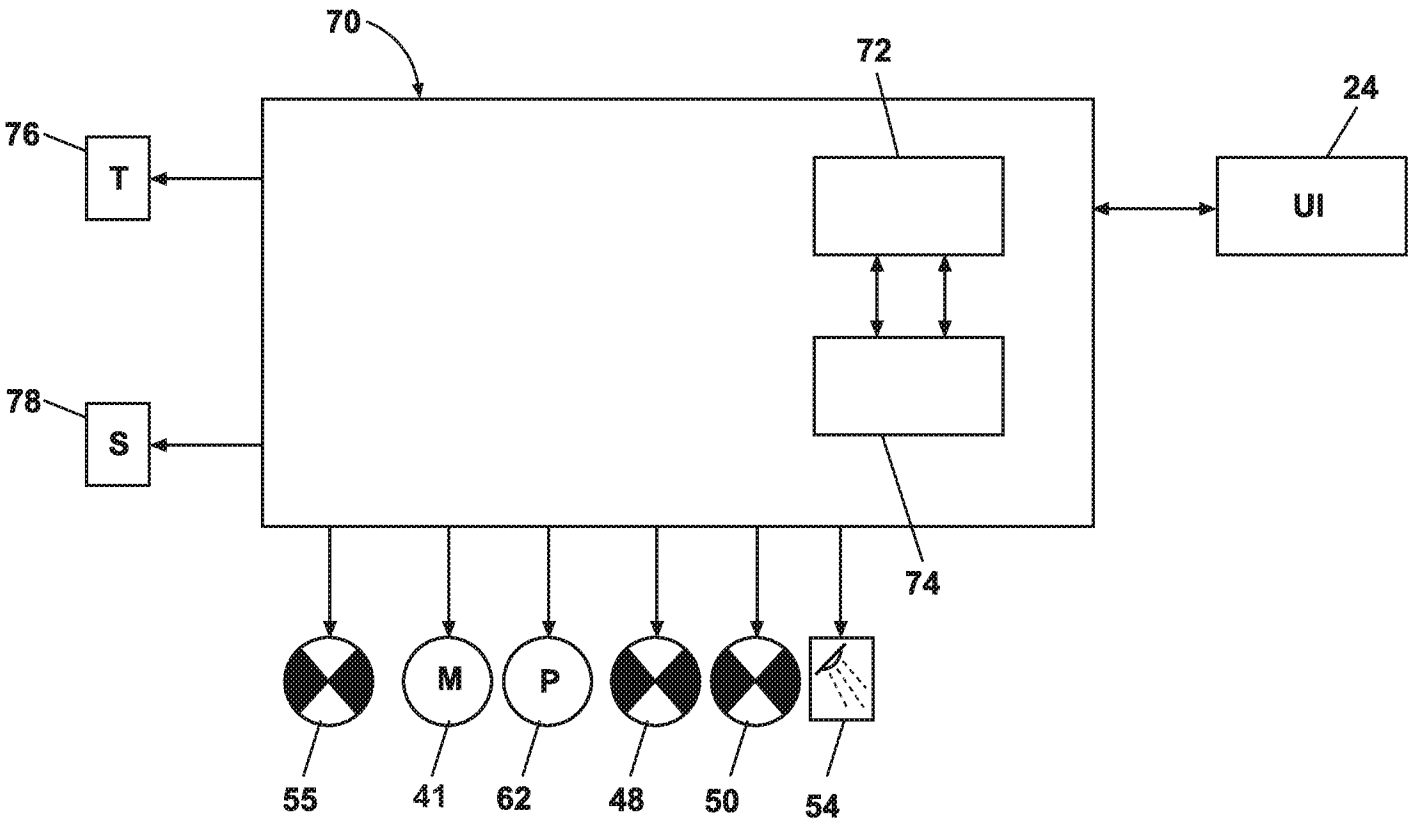
FIG. 2 illustrates a schematic representation of a controller for controlling the operation of one or more components of the laundry treating appliance of FIG. 1.

As illustrated in FIG. 2, the controller 70 can be provided with a memory 72 and a central processing unit (CPU) 74. The memory 72 can be used for storing the control software that can be executed by the CPU 74 in completing a cycle of operation using the washing machine 10 and any additional software. Examples, without limitation, of treating cycles of operation include: wash, heavy-duty wash, delicate wash, quick wash, pre-wash, refresh, rinse only, and timed wash, which can be selected at the user interface 24. The memory 72 can also be used to store information, such as a database or table, and to store data received from the one or more components of the washing machine 10 that can be communicably coupled with the controller 70. The database or table can be used to store the various operating parameters for the one or more cycles of operation, including factory default values for the operating parameters and any adjustments to them by the control system or by user input.

The controller 70 can be operably coupled with one or more components of the washing machine 10 for communicating with and/or controlling the operation of the components to complete a cycle of operation. For example, the controller 70 can be coupled with the hot water valve 48, the cold water valve 50, diverter valve 55, and the detergent dispenser 54 for controlling the temperature and flow rate of treating liquid into the treating chamber 32; the pump 62 for controlling the amount of treating liquid in the treating chamber 32 or sump 60; drive system 40 including a motor 41 for controlling the direction and speed of rotation of the basket 30 and/or the clothes mover 38; and the user interface 24 for receiving user selected inputs and communicating information to the user. The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also receive input from various additional sensors 78, which are known in the art and not shown for simplicity. Non-limiting examples of additional sensors 78 that can be communicably coupled with the controller 70 include: a weight sensor, and a motor torque sensor.

Figure 3:
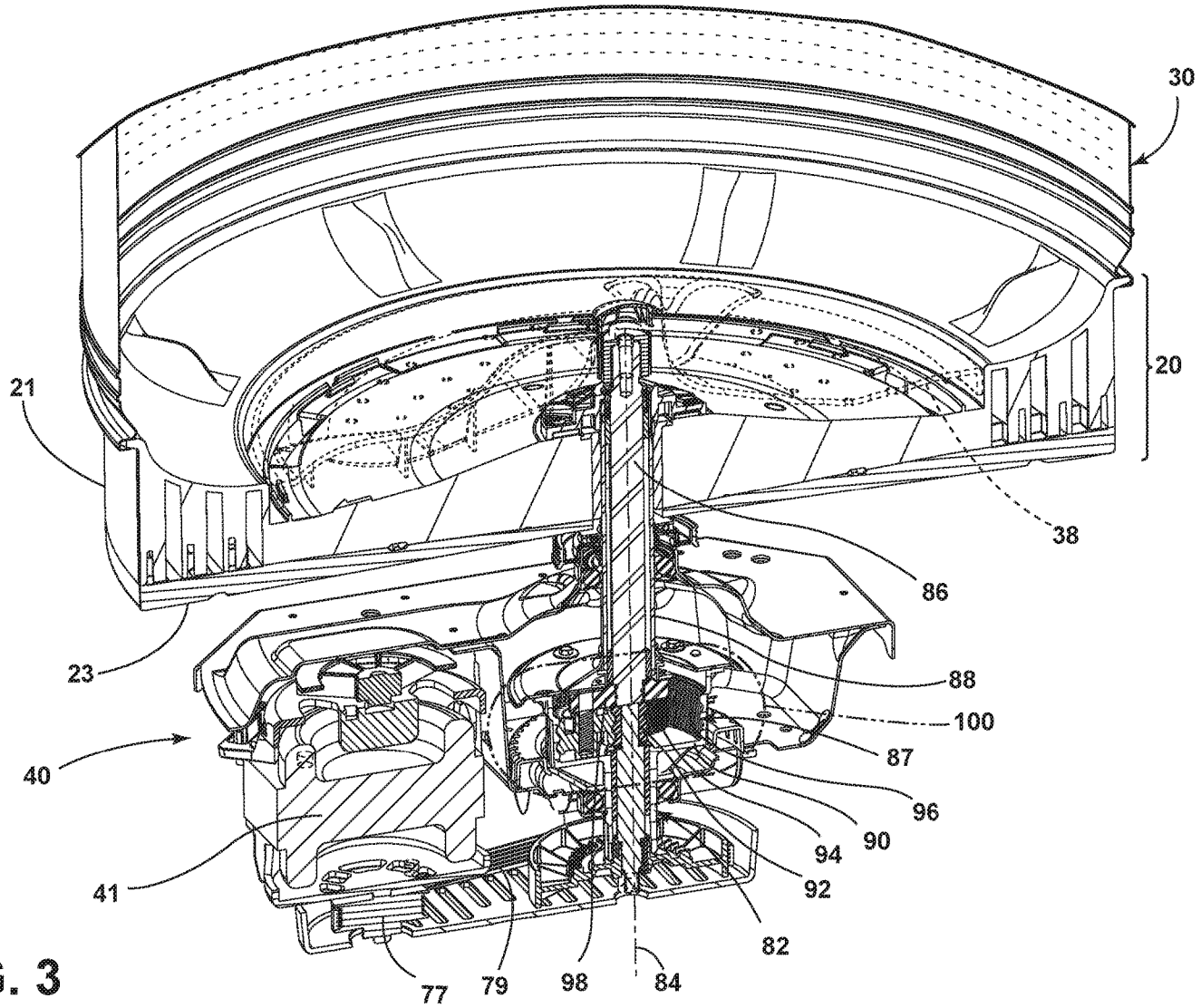
FIG. 3 illustrates a perspective view of a portion of a basket, clothes mover and drive system that can be included in the laundry treating appliance of FIG. 1 in accordance with the present disclosure.

FIG. 3 shows in greater detail the basket 30, clothes mover 38, and drive system 40. The motor 41 can be drivingly coupled to the clothes mover 38 to selectively oscillate or rotate the clothes mover 38. More specifically, the motor 41 can include an output 77 that is connected through a belt system 79 to a first drive shaft 82 configured to rotate about an axis of rotation 84. Alternatively, the motor 41 could be directly connected to the first drive shaft 82. The first drive shaft 82 can further include a second drive shaft 86 configured to couple with and rotate the clothes mover 38 and a third drive shaft, which is illustrated as a spin tube 88, configured to couple with and rotate the basket 30. As shown, the second drive shaft 86 can be concentric to, and positioned within the interior diameter of the spin tube 88. Each of the second drive shaft 86 and spin tube 88 can be configured to rotate, for example, independently of the other, in unison with the other, or at dissimilar rotational speeds or directions from the other.

The drive system 40 can further include a helical drive mechanism 100 having a planetary gear system or mechanism, which can be provided within a planetary gearbox 87. The planetary gearbox 87 can include a gearbox housing 90, a helical sun gear 92, a set of helical planet gears 94, and an outer concentric helical ring gear 96, wherein the gears 92, 94, 96 are positioned within the housing 90. It is also contemplated that the outer concentric helical ring gear 96 and the housing 90 can be provided as one piece wherein the housing 90 forms the outer concentric helical ring gear 96. The helical sun gear 92 is rotationally coupled with the first drive shaft 82, and includes teeth 92*a* configured to mesh with teeth 94*a* on the helical planet gears 94 and to rotate the set of helical planet gears 94. The helical planet gears 94 are positioned concentrically about the helical sun gear 92 and within the outer helical ring gear 96, such that the teeth 94*a* of helical planet gears 94 mesh with teeth 96*a* of the outer helical ring gear 96. Each of the helical planet gears 94 is coupled with a planet carrier 98 such that the rotation of the helical planet gears 94 about the helical ring gear 96, as driven by the helical sun gear 92, rotates the planet carrier 98 about the axis of rotation 84. The planet carrier 98 can be further coupled with the second drive shaft 86 to rotate the clothes mover 38. The helical ring gear 96 is operably connected with the basket 30 via the spin tube 88. The helical sun gear 92, helical planet gears 94 and outer helical ring gear 96 can be collectively thought of as a helical gear assembly.

The planetary gearbox 87 can be configured in any suitable manner including that it can be configured in a speed-reducing configuration, for example by planetary gear reduction, such that the output rotational speed of the second drive shaft 86 is less than the rotational speed of the first drive shaft 82. The planetary gearbox 87, helical sun gear 92, helical planet gears 94, helical ring gear 96, and the like, can be configured or selected to provide a desired rotational speed-reducing ratio based on the rotational speed of the first drive shaft 82, the desired rotational speed of the clothes mover 38, or the desired agitation of the washing machine 10 or the cycle of operation.

The motor 41 operates as controlled by the controller 70. The rotational speed of the first drive shaft 82 can be reduced by the planetary gearbox 87 and delivered to the clothes mover 38 to rotate the clothes mover 38, which ultimately provides movement to the laundry load contained within the laundry treating chamber 32. When the washing machine 10 is operating in the agitate mode, the motor 41 is operated in a reversing fashion which causes the first drive shaft 82 to oscillate, thus driving the helical sun gear 92 in alternating opposite directions. The clothes mover 38 is therefore oscillated through its connection with the helical planet gears 94. The wash basket 30 can be held stationary while the clothes mover 38 is oscillated, for example by means of a brake mechanism (not shown).

A clutch mechanism, which can include the helical drive mechanism 100, is included and allows for switching the washing machine 10 between a mode in which the clothes mover 38 oscillates relative to the basket 30 and a mode in which the clothes mover 38 and the basket 30 rotate together. In exemplary implementations, the clothes mover 38 may oscillate during a wash cycle to provide agitation, and the clothes mover 38 and the basket 30 may spin together during a spin cycle.

Figure 4:
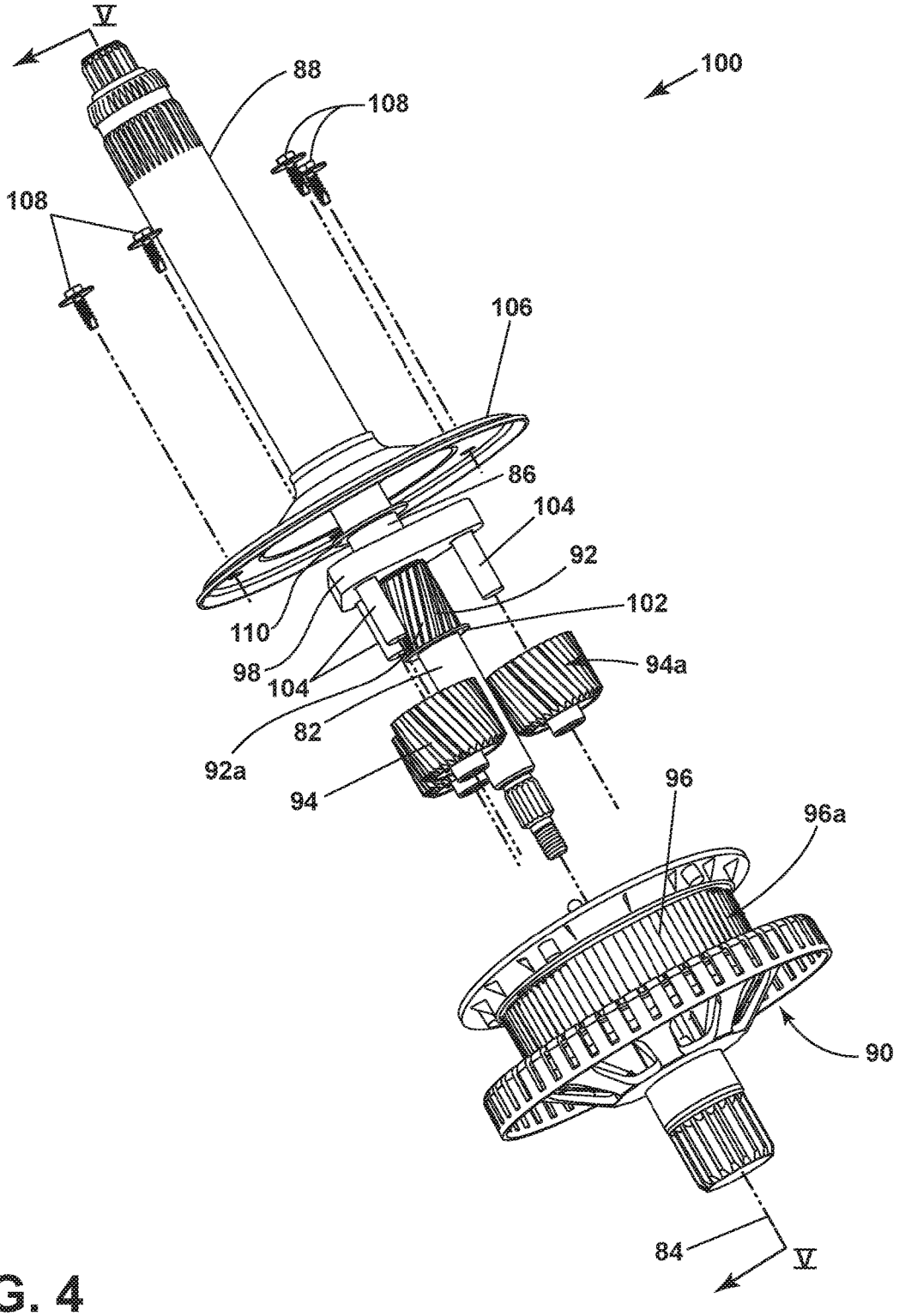
FIG. 4 illustrates an exploded view of a helical drive mechanism that can be utilized in the drive system of FIG. 3 according to a first embodiment of the present disclosure.

Turning now to FIG. 4, the helical drive mechanism 100 is shown in enlarged and exploded detail. The helical drive mechanism 100 can be used within a washing machine 10 having suitable capacity. In an exemplary embodiment, the helical drive mechanism 100 can be used within a washing machine 10 having a low capacity tub 34. Non-limiting examples of such a low capacity can include tubs 34 having a volume of at least 3.5 cubic feet and not greater than 4.4 cubic feet.

The helical drive mechanism 100 comprises an input washer 102 between the helical sun gear 92 and the housing 90 that defines the helical ring gear 96. The input washer 102 can be formed of any suitable material, non-limiting examples of which include metal or plastic. Helical planet gears 94 circumferentially surround the helical sun gear 92 and are received on a plurality of carrier posts 104 extending downwardly from the planet carrier 98. Planet carrier 98 is received about the second drive shaft 86. Above the planet carrier 98 and received about the spin tube 88 is an upper cover 106. The upper cover 106 can be secured to the housing 90 by a plurality of fasteners 108. The fasteners 108 can be any suitable type of fastener, including, but not limited to, screws, bolts, snap-in fasteners, etc. Between the planet carrier 98 and the upper cover 106 can be provided a carrier washer 110.

The plurality of teeth 92*a* of the helical sun gear 92 are provided about the outer circumferential surface of the helical sun gear 92. The teeth 92*a* on the helical sun gear 92 are at an angle relative to the axis of rotation 84. The plurality of teeth 94*a* of the helical planet gears 94 are also provided about the outer circumferential surface of the helical planet gears 94. The teeth 94*a* of the helical planet gears 94 are also at an angle relative to the axis of rotation 84. In an exemplary embodiment, the teeth 94*a* of the helical planet gears 94 are provided at an angle the same as the teeth 92*a* of the helical sun gear 92 so that the teeth 94*a* of the helical planet gears 94 can mesh with the teeth 92*a* of the helical sun gear 92. Further, the plurality of teeth 96*a* of the helical ring gear 96 are provided about the inner circumferential surface of the helical ring gear 96 and are provided at an angle relative to the axis of rotation 84. The teeth 96*a* of the helical ring gear 96 are provided at an angle the same as the teeth 94*a* of the helical planet gears 94 so that the teeth 94*a* of the helical planet gears 94 can mesh with the teeth 96*a* of the helical ring gear 96. While the helical drive mechanism 100 is illustrated herein as having three helical planet gears 94, it will be understood that any suitable number of helical planet gears 94 can be provided, including only a single helical planet gear 94. Further, in an exemplary embodiment, regardless of the number of helical planet gears 94 provided, the helical planet gears 94 can be equally spaced circumferentially around the helical sun gear 92 to reduce vibration in the helical drive mechanism 100, and also in the washing machine 10 overall.

The carrier washer 110 provided between the planet carrier 98 and the upper cover 106 in the helical drive mechanism 100 can prevent contact between the planet carrier 98 and the upper cover 106, and can also or alternately dampen contact between the planet carrier 98 and the upper cover 106. The carrier washer 110 can be formed from any suitable material, such as a plastic or a resin. In an exemplary embodiment, the carrier washer 110 can be formed from or comprised of a plastic that is sufficiently durable to withstand the wear of normal operation of the drive system 40. One such example includes, but is not limited to, a polyetheretherketone (PEEK) based resin, which can be further provided with fillers such as nylon, a non-limiting example of which includes aramid, or a polytetrafluoroethylene, a non-limiting example of which includes Teflon™. The carrier washer 110 can have any suitable thickness such that the gap between the planet carrier 98 and the upper cover 106 allows.

It is further contemplated carrier washer 110 can be any suitable thickness. By way of non-limiting example, during production of the helical drive mechanism 100, each helical drive mechanism 100 produced can be measured to determine the thickness of carrier washer 110 best suited in that individual helical drive mechanism 100. In an exemplary embodiment, carrier washers 110 made available during the manufacturing process have exemplary thicknesses of 1.0 mm and 1.4 mm.

Figure 5:
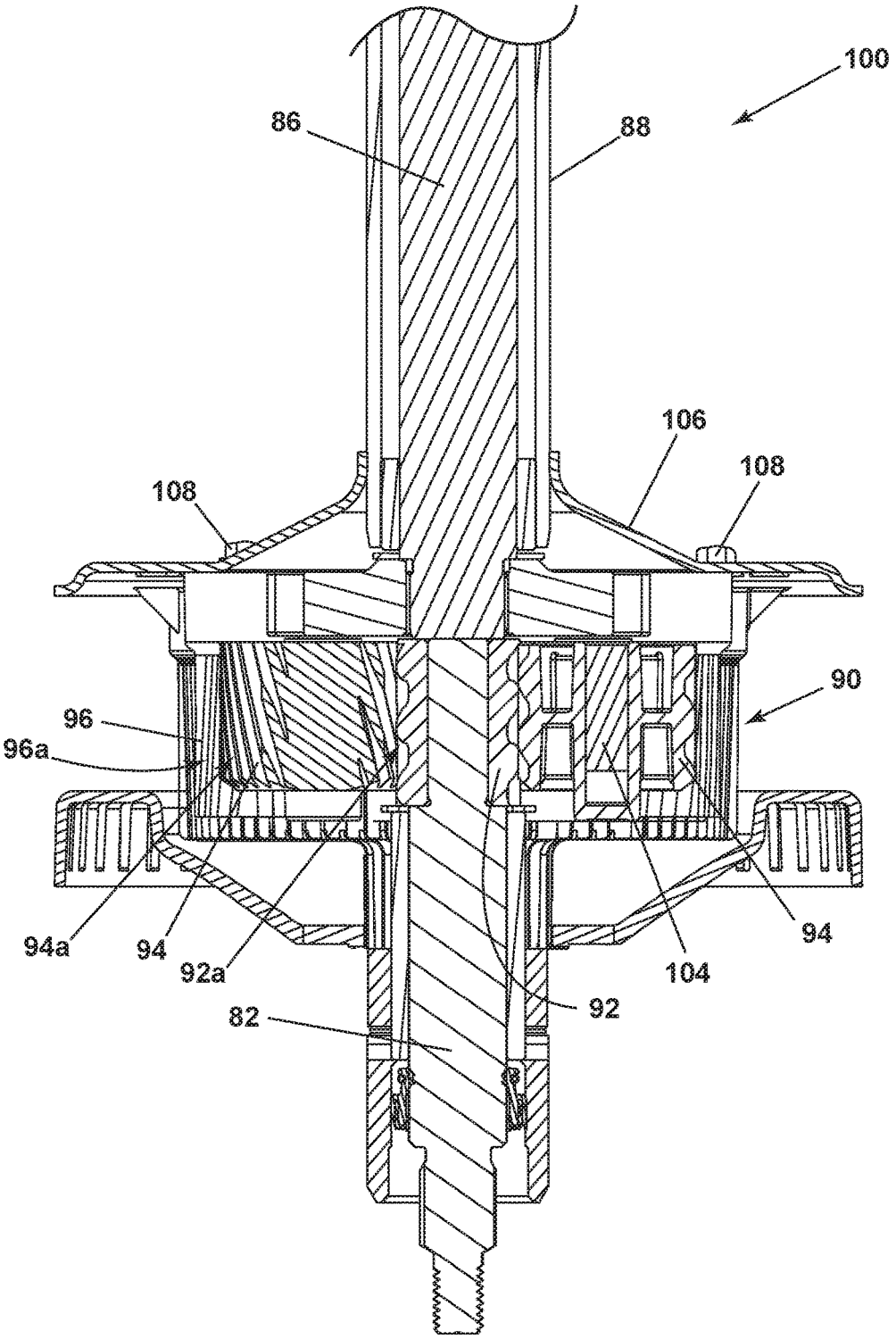
FIG. 5 illustrates a cross-sectional view of the helical drive mechanism of FIG. 4.

FIG. 5 illustrates a cross-sectional view of the helical drive mechanism 100 in an assembled position to better show the meshing between the teeth 92*a* of the helical sun gear 92 and the teeth 94*a* of the helical planet gears 94, as well as between the teeth 94*a* of the helical planet gears 94 and the teeth 96*a* of the helical ring gear 96. The mesh between the teeth 92*a*, 94*a* of the helical sun gear 92 and any helical planet gear 94 or between the teeth 94*a*, 96*a* of any helical planet gear 94 and the helical ring gear 96 can be described in terms of contact ratios, which quantify and further characterize the effective number of teeth 92*a*, 94*a*, 96*a* between the helical gears 92, 94 or 94, 96 that are in mesh at the same time.

Figure 6:
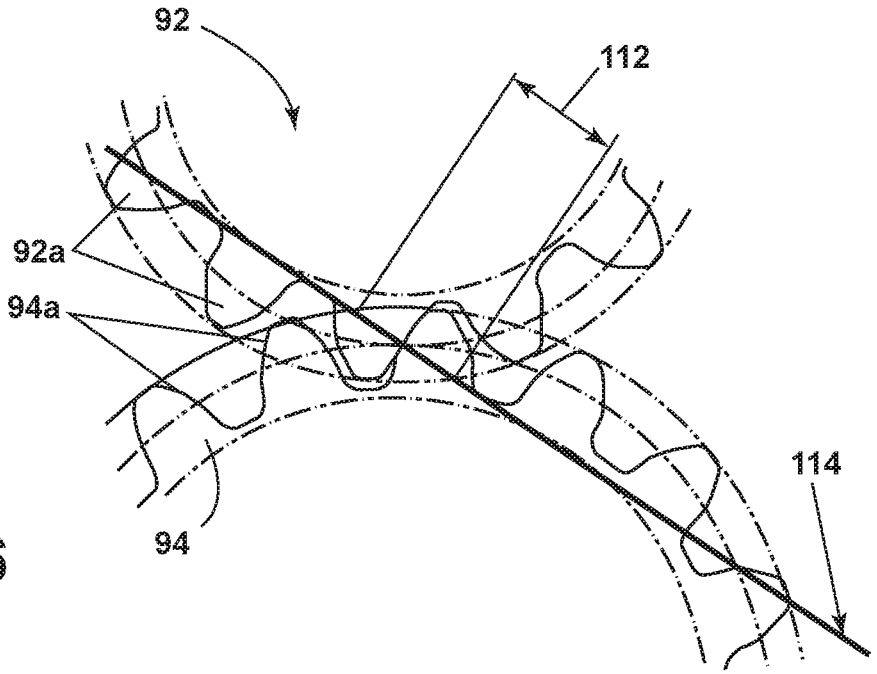
FIG. 6 illustrates a top view of helical gears that can be utilized in the helical drive mechanism of FIG. 4.

Referring now to FIG. 6, a top view of an exemplary meshing between teeth 92*a*, 94*a* of the helical sun gear 92 and helical planet gears 94 is illustrated. While FIG. 6 illustrates the meshing between helical sun gear 92 and helical planet gears 94, it will be understood that the aspects and measurements illustrated herein are also representative of the meshing between teeth 94*a*, 96*a* of the helical planet gears 94 and the helical ring gear 96. From such a view, measurements of different aspects of the meshing can be used to measure and define a gear transverse contact ratio. The gear transverse contact ratio can be described as the effective number of teeth 92*a*, 94*a* in mesh at the same time along the transverse profile of the teeth 92*a*, 94*a*. A length of action 112 of the meshing of the teeth 92*a*, 94*a* is the length of a specific portion of a line of action 114, the length of action 112 being measured as indicated by the distance 112 as shown. The gear transverse contact ratio is calculated by dividing the length of action 112 by a transverse base pitch 116 (FIG. 7).

Figure 7:
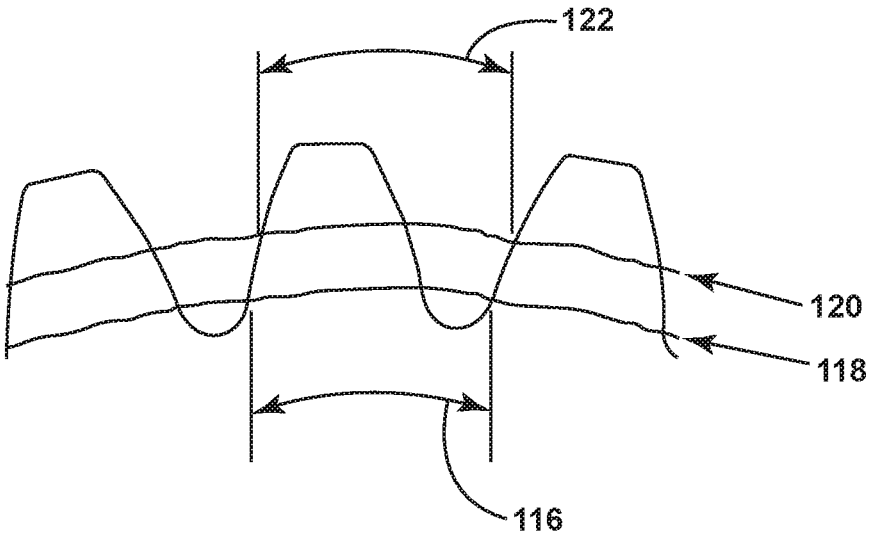
FIG. 7 illustrates a top view of helical gear teeth that can be utilized in the helical gears of FIG. 6.

FIG. 7 illustrates a top view of an exemplary arrangement of the teeth 92*a*, 94*a* of the helical sun gear 92 or helical planet gears 94. While FIG. 7 illustrates the teeth 92*a*, 94*a* of the helical sun gear 92 or helical planet gears 94, it will be understood that the aspects and measurements illustrated herein also apply to the teeth 96*a* of the helical ring gear 96. Looking either down from the top or up from the bottom of the teeth 92*a*, 94*a*, a base circle 118 and a pitch circle 120 can be defined. The distance 116 that is defined by the circumference and curvature of the base circle 118 and represents a transverse base pitch 116, can be divided into the length of action 112 as described with respect to FIG. 6 in order to define a gear transverse contact ratio. In the same view, the distance 122 that is defined by the circumference and curvature of the pitch circle 120 represents a transverse circular pitch 122.

Figure 8:
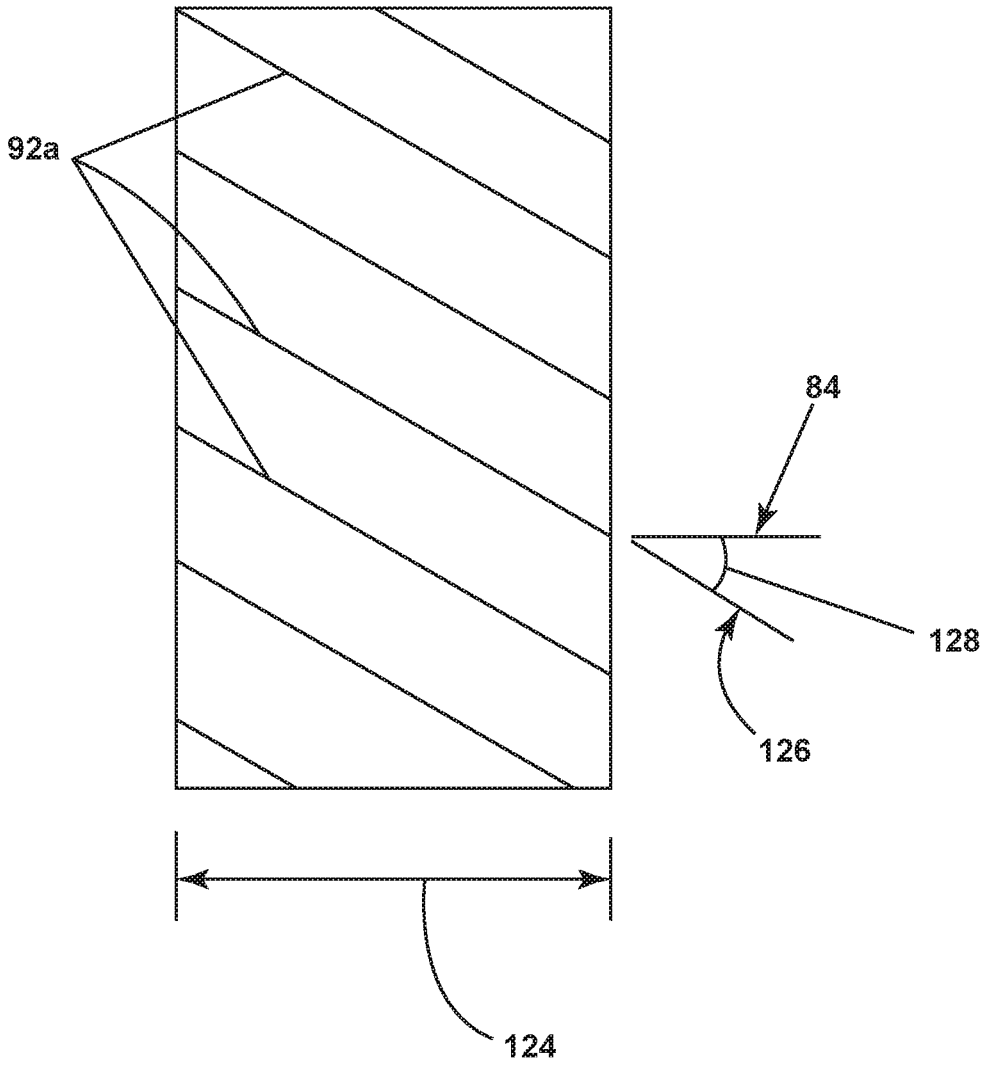
FIG. 8 illustrates a front view of a helical gear of FIG. 6.

FIG. 8 illustrates a front view of an exemplary arrangement of the teeth 92*a* of the helical sun gear 92, and specifically of the angle at which the teeth 92*a* are provided relative to the axis of rotation 84. While FIG. 8 illustrates the teeth 92*a* of the helical sun gear 92, it will be understood that the aspects and measurements illustrated herein also apply to the teeth 94*a*, 96*a* of the helical sun gears 94 and helical ring gear 96. The angle of the teeth 92*a* is indicated by the line 126. The line 126 forms a helix angle 128 relative to the axis of rotation 84. FIG. 8 further illustrates how a face width 124 of the helical sun gear 92 can be measured, which is the vertical height of the helical sun gear 92.

The face width 125 can be multiplied by the tangent of the helix angle 128 to define a face advance. The face advance can then be divided by the transverse circular pitch 122 as illustrated in FIG. 7 to yield a face contact ratio. The face contact ratio, which can also be described as an overlap ratio, can be described as the effective number of teeth 92*a*, 94*a*, 96*a* in mesh at the same time along the face of the teeth 92*a*, 94*a*, 96*a*. The sum of the gear transverse contact ratio and the face contact ratio defines a total contact ratio. The total contact ratio can be described as the effective number of teeth 92*a*, 94*a*, 96*a* between the helical gears 92, 94 or 94, 96 that are in mesh at the same time, along both the face of the teeth 92*a*, 94*a*, 96*a* and the transverse profile of the teeth 92*a*, 94*a*, 96*a*.

In a conventional spur gear assembly, where the teeth of the spur gears are oriented vertically, the total contact ratio is generally 1:1. In the helical gear assembly, the total contact ratio is greater than 3:1. Specifically, in an exemplary embodiment, the gear transverse contact ratio of the helical drive mechanism 100 is greater than or equal to 1.1:1. and the face contact ratio of the helical drive mechanism 100 is greater than or equal to 2.0.1. The characteristics, non-limiting examples of which include the height, circumference, and curvature of the helical gears 92, 94, 96 and the angle of the helical teeth 92*a*, 94*a*, 96*a* relative to the axis of rotation 84, of the helical sun gear 92, helical planet gears 94, and helical ring gear 96 can be selected so as to optimize the total contact ratio of the meshing of the gears by optimizing the number of teeth 92*a*, 94*a*, 96*a*, the shape of the teeth 92*a*, 94*a*, 96*a*, and the angle of the teeth 92*a*, 94*a*, 96*a* relative to the axis of rotation 84.

Further, in an exemplary embodiment, the helical sun gear 92 and the helical planet gears 94, as well as the helical planet gears 94 and the helical ring gear 96, are provided at differing degrees of rotation such that the pairs of gears are out of phase, or have differing mesh phasing, with one another in order to provide improved meshing of the gears and reduce grinding noise and vibration during operation. By ensuring that the degree of rotation between the helical sun gear 92 and helical planet gears 94 differs from the degree of rotation between the helical planet gears 94 and the helical ring gear 96 to define a differing mesh phasing, the teeth 92*a*, 94*a*, 96*a* that meshed between one pair of the helical gears 92, 94, 96, can provide stability and reduced vibration to the helical drive mechanism 100, even while the teeth 92*a*, 94*a*, 96*a* between another pair of the helical gears 92, 94, 96 may be coming into mesh with one another. This reduction in vibration within the helical drive mechanism 100 results in a reduction of grinding noise within the helical drive mechanism 100 and a quieter operation as perceived by a user.

Figure 9:
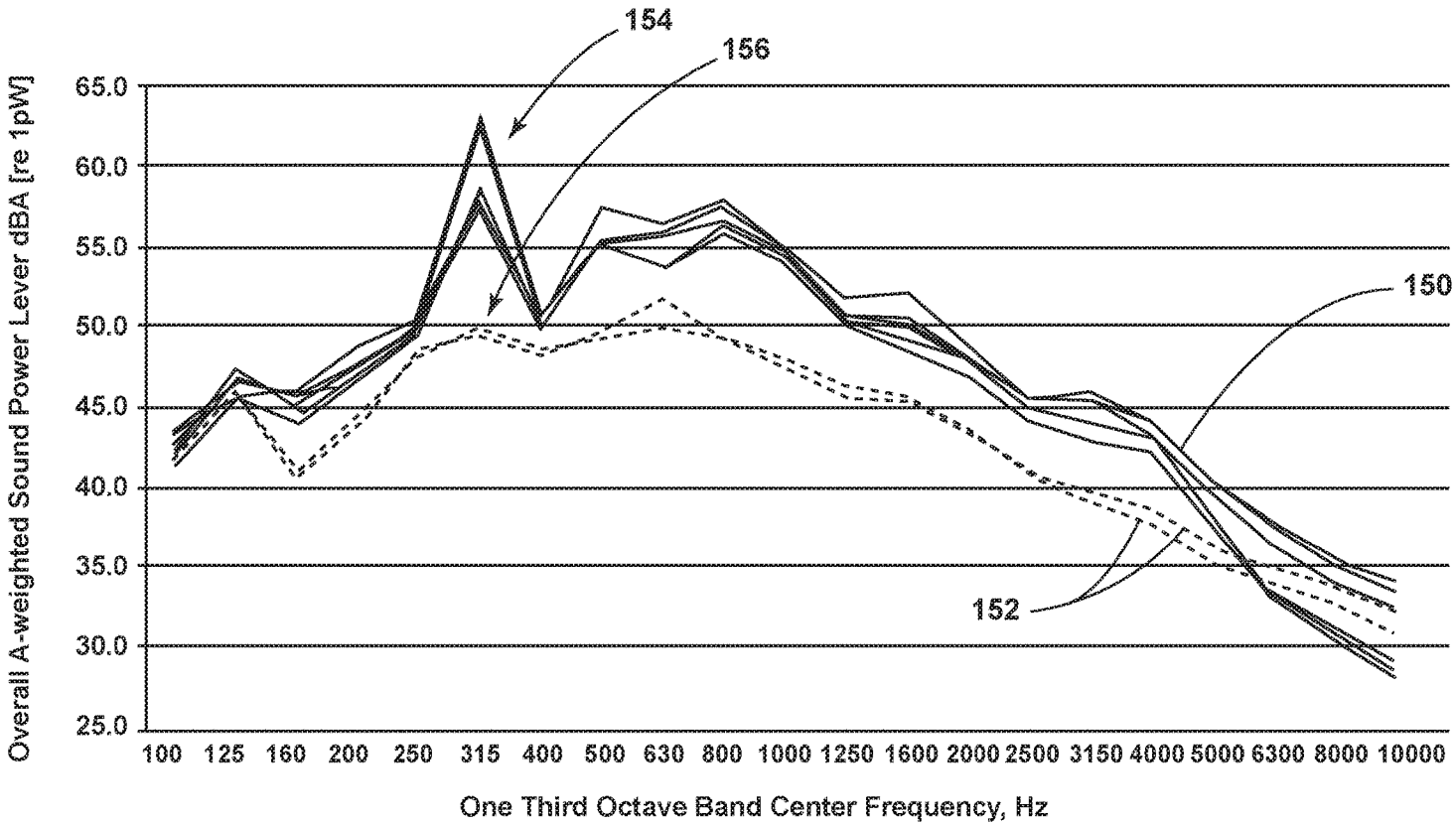
FIG. 9 illustrates a sound power plot representing the operation of the helical drive mechanism of FIG. 4.

FIG. 9 illustrates a sound power plot during the operation of the helical drive mechanism 100. Specifically, the sound power plot represents sound power generated during the agitate mode of the washing machine 10, when the clothes mover 38 is driven to move back and forth by the motor 41. The washing machine 10 can perform one or more manual or automatic treating cycles or cycles of operation. A common cycle of operation includes a wash phase, a rinse phase, and a spin extraction phase. Other phases for cycles of operation include, but are not limited to, intermediate extraction phases, such as between the wash and rinse phases, and a pre-wash phase preceding the wash phase, and some cycles of operation include only a select one or more of these exemplary phases. Agitation may be employed during any of these phases, but is particularly suitable for the wash phase, as agitation may impart mechanical action on a laundry load that improves cleaning performance.

Turning now to the operation of the drive system 40 and the helical drive mechanism 100, the motor 41 is configured to drive the clothes mover 38 to rotate. As the motor 41 drives the rotation of the first drive shaft 82 in a first direction, the rotation is transferred through the helical gear assembly of the helical sun gear 92, helical planet gears 94, and the helical ring gear 96 to drive rotation of the planet carrier 98. Particularly during an agitate mode when the motor 41 is driving the helical drive mechanism 100 backwards and forwards repeatedly, grinding can occur between the helical sun gear 92 and the helical planet gears 94, as well as between the helical planet gears 94 and the helical ring gear 96. This can create a gear grinding noise that can be unpleasant to a user. Further, back and forth rotation of the helical gear assembly causes the helical sun gear 92 to move upward and downward along the first drive shaft 82 repeatedly. Each time the helical sun gear 92 moves upwardly along the first drive shaft 82, the helical sun gear 92 contacts the planet carrier 98, which results in the planet carrier 98 contacting the upper cover 106. The contact between the planet carrier 98 and the upper cover 106 can result in further unpleasant noise to the user.

Noise generated by contact between the planet carrier 98 and the upper cover 106 is reduced by the presence of the carrier washer 110, which prevents or dampens direct contact between the planet carrier 98 and the upper cover 106. The sound power plot of FIG. 9 further illustrates how the incorporation of the helical drive mechanism 100 serves to further reduce unpleasant noise to the user. The lines 150 shown in solid line represent sound power profiles of washing machines using spur gear assemblies. At the point indicated by the arrow 154, a peak in sound power level is shown. The peak indicated by arrow 154 represents an increase in sound power at the frequency at which the gear grinding noise can be heard, or the gear mesh frequency. The gear mesh frequency is a function of the number of teeth provided on the gears, as well as the design, including angle and shape, of the teeth on the gears. However, the lines 152 shown in dashed line represent sound power profiles of washing machines 10 comprising helical drive mechanisms 100. It is shown that in the washing machines 10 with helical drive mechanisms 100, the increase in sound power at the frequency of the gear grinding noise, as indicated by arrow 156, is not observed. Rather, the use of the helical drive mechanism 100 results in a reduction in sound power level of about 10 dBA at the fundamental gear mesh frequency.

Figure 10:
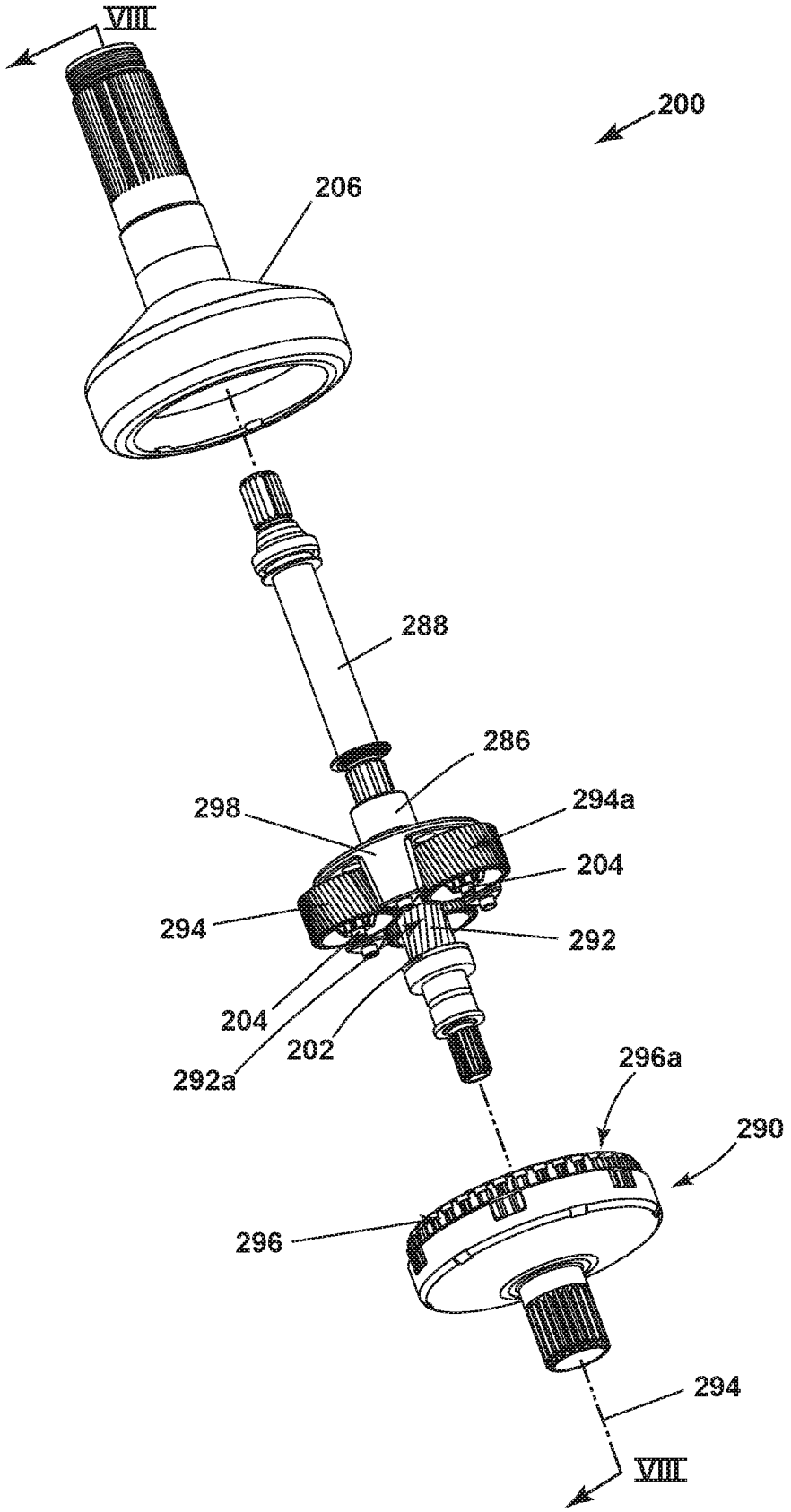
FIG. 10 illustrates an exploded view of a helical drive mechanism that can be utilized in the drive system of FIG. 3 according to a second embodiment of the present disclosure.
Figure 11:
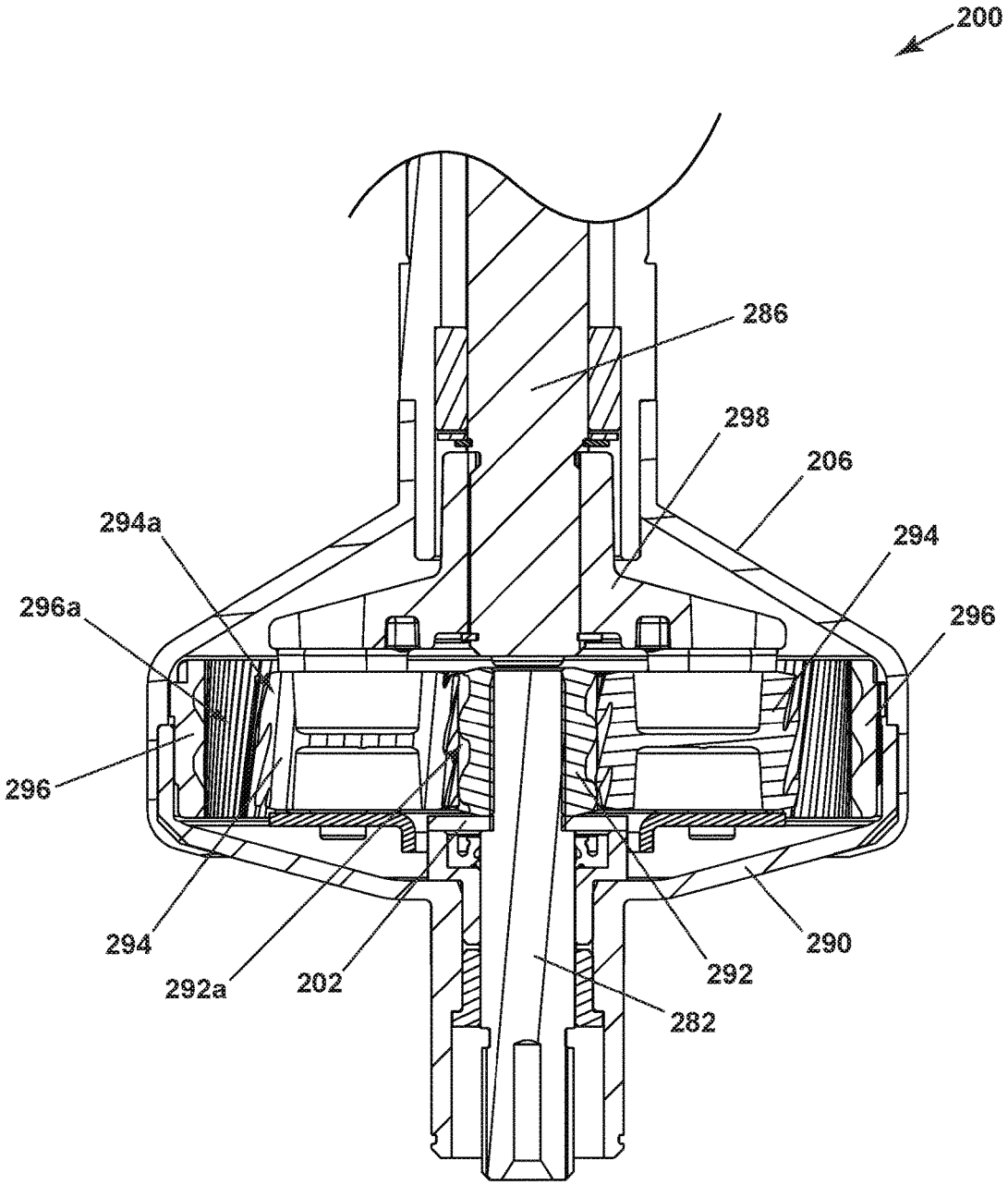
FIG. 11 illustrates a cross-sectional view of the helical drive mechanism of FIG. 10.
Figure 12:
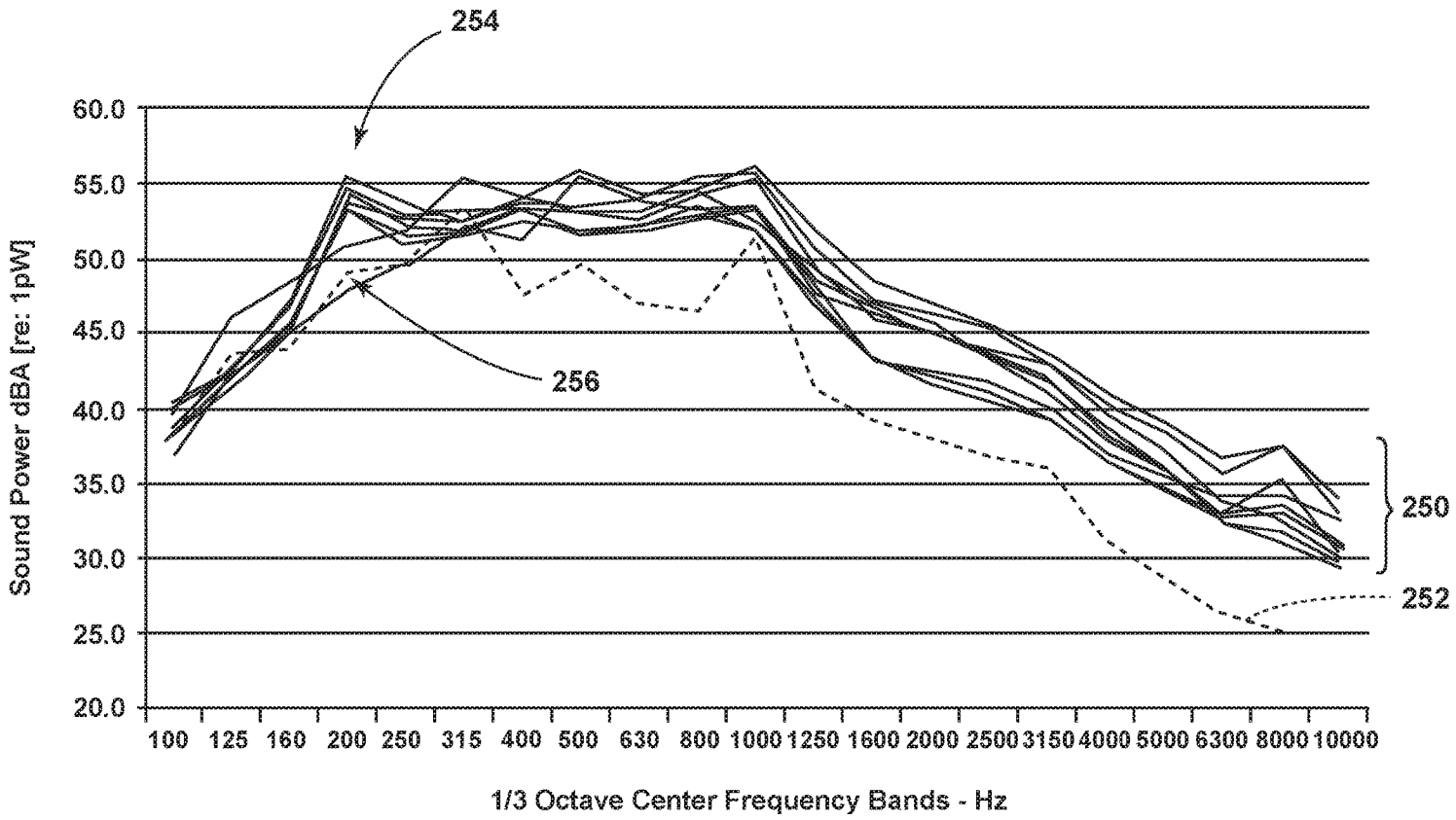
FIG. 12 illustrates a sound power plot representing the operation of the helical drive mechanism of FIG. 10.

FIGS. 10-12 illustrate a second embodiment of a helical drive mechanism 200, which is similar to the first helical drive mechanism 100 except for the carrier washer 110 and the upper cover 106. Therefore, elements in the helical drive mechanism 200 similar to those of the helical drive mechanism 100 will be numbered with the prefix 200.

Turning now to FIG. 10, the helical drive mechanism 200 is shown in enlarged and exploded detail. The helical drive mechanism 200 can be used within a washing machine 10 having suitable capacity. In an exemplary embodiment, the helical drive mechanism 200 can be used within a washing machine 10 having a high capacity tub 34. Non-limiting examples of such a high capacity can include tubs 34 having a volume of at least 4.7 cubic feet and not greater than 6.2 cubic feet. The helical drive mechanism 200 further comprises an input washer 202, which can be a shim, that is provided below the helical sun gear 292 that is coupled to the first drive shaft 282, between the helical sun gear 292 and the housing 290 that can define or contain the helical ring gear 296. In an exemplary embodiment, the input washer 202 can be formed of metal. The helical planet gears 294 are received on a plurality of carrier posts 204 that extend downwardly from the planet carrier 298. The planet carrier 298 is received about the second drive shaft 286. Above the planet carrier 298 and received about the spin tube 288 is an upper cover 206. Because the spacing between the planet carrier 298 and the upper cover 206 is much smaller than in the first embodiment of the helical drive mechanism 100, no carrier washer is provided. In an exemplary embodiment of the helical drive mechanism 200, the angle and spacing of the teeth 292*a*, 294*a*, 296*a* on the helical sun gear 292, helical planet gears 294, and the helical ring gear 296 do not differ from those described in the first embodiment of the helical drive mechanism 100, and the teeth 292*a*, 294*a*, 296*a* are still provided at an angle, and not parallel, relative to the axis of rotation 284.

FIG. 11 illustrates a cross-sectional view of the helical drive mechanism 200 in an assembled position to better show the meshing between the teeth 292*a* of the helical sun gear 292 and the teeth 294*a* of the helical planet gears 294, as well as between the teeth 294*a* of the helical planet gears 294 and the teeth 296*a* of the helical ring gear 296. In an exemplary embodiment, the mesh between the teeth 292*a*, 294*a* of the helical sun gear 292 and the helical planet gears 294, as well as between the teeth 294*a*, 296*a* of the helical planet gears 294 and the helical ring gear 296, as quantified by the total contact ratio, the gear transverse contact ratio, and the face contact ratio, does not differ from those described in the first embodiment of the helical drive mechanism 100. That is, the helical drive mechanism 200 maintains a total contact ratio greater than 3 and more specifically with a gear transverse contact ratio greater than or equal to 1.1:1 and a face contact ratio greater than or equal to 2.0:1. Further, in an exemplary embodiment of the helical drive mechanism 200, the helical sun gear 292 and the helical planet gears 294, as well as the helical planet gears 294 and the helical ring gear 296, are still provided at differing degrees of rotation such that the pairs of gears are out of phase, or have differing mesh phasing, with one another in order to provide improved meshing of the gears and reduce grinding noise and vibration during operation.

FIG. 12 illustrates a sound power plot during the operation of the helical drive mechanism 200. Specifically, the sound power plot represents sound power generated during the agitate mode of the washing machine 10, when the clothes mover 38 is driven to move back and forth by the motor 41, the operation of which was described previously in reference to FIG. 9. The sound power plot of FIG. 12 further illustrates how the incorporation of the helical drive mechanism 200 reduces unpleasant noise to the user. The lines 250 shown in solid line represent sound power profiles of washing machines using spur gear assemblies. At the point indicated by the arrow 254, a peak in sound power level is shown. The peak indicated by arrow 254 represents an increase in sound power at the frequency at which the gear grinding noise can be heard. However, the lines 252 shown in dashed line represent sound power profiles of washing machines 10 comprising helical drive mechanisms 200. It is shown that in the washing machines 10 with helical drive mechanisms 200, the increase in sound power at the frequency of the gear grinding noise, as indicated by arrow 256, is smaller than that observed from the spur gear assembly. The use of the helical drive mechanism 200 results in a reduction in sound power level of about 4 dBA at the fundamental gear mesh frequency of the helical drive mechanism 200.

In a traditional vertical axis laundry treating appliance, the drive mechanism, and specifically the gear assembly, can be a significant contributor to noise generated by the washing machine during its operation, generating user complaints and requiring significant spending to address the issue. In drive mechanisms using a traditional spur gear assembly, with gears having vertical threads, it is difficult to mitigate the gear grinding noise that results. The various aspects described herein allow for removal of the spur gear assembly in favor of a helical gear assembly or helical drive mechanism. The helical drive mechanism results in smoother gear operation, a reduction in gear grinding noise, and an overall quieter operation. Furthermore, having the gears be rotationally positioned out of phase with one another to facilitate proper tooth meshing, as well as using equidistantly spaced helical planet gears, can reduce vibration within the drive system and within the washing machine as a whole, as well as decreasing error in the transmission or drive system.

Furthermore, the incorporation of a carrier washer that is made from a specialized plastic resin serves to damp knocking noise that can occur from the axial thrust generated by gear reversal and the repeated upward movement of the sun gear against the planet carrier, particularly during the agitation cycle.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance, comprising:
- a tub defining an interior;
- a basket with a spin tube located within the interior and rotatably mounted within the tub;
- a motor having a first drive shaft;
- a clothes mover rotatably mounted within the basket and having a second drive shaft; and
- a clutch having a helical drive mechanism comprising:
  - a helical sun gear driven by the first drive shaft;
  - at least one helical planet gear driven by the helical sun gear;
  - a planet carrier driven by the at least one helical planet gear, the planet carrier selectively coupled to the second drive shaft to rotate the clothes mover; and
  - an outer helical ring gear driven by the at least one helical planet gear, the outer helical ring gear operably coupled to the spin tube to rotate the basket;
  - wherein at least one of the helical sun gear, the at least one helical planet gear, or the helical ring gear is provided at a differing degree of rotation from at least another of the helical sun gear, the at least one helical planet gear, or the helical ring gear such that meshes formed by teeth between the helical sun gear, the at least one helical planet gear, or the helical ring gear have differing mesh phasing.

2. The laundry treating appliance of claim 1 wherein the at least one helical planet gear comprises at least two helical planet gears, with one of the helical planet gears having differing mesh phasing with the helical sun gear from another of the helical planet gears.

3. The laundry treating appliance of claim 1 wherein the meshes comprise the helical sun gear, the at least one helical planet gear, and the helical ring gear each defining a plurality of teeth that mesh with the teeth of the other gears to define the mesh phasing.

4. The laundry treating appliance of claim 1 wherein the helical drive mechanism further comprises a carrier washer provided above the planet carrier, the carrier washer comprising polyetheretherketone based resin.

5. The laundry treating appliance of claim 4 wherein the polyetheretherketone based resin further comprises at least one of a nylon or a polytetrafluoroethylene filler.

6. The laundry treating appliance of claim 5 wherein the nylon filler is an aramid.

7. The laundry treating appliance of claim 5 wherein the polytetrafluoroethylene filler is Teflon™.

8. The laundry treating appliance of claim 4 wherein the helical drive mechanism further comprises an upper cover provided circumferentially about the spin tube.

9. The laundry treating appliance of claim 8 wherein the carrier washer is provided between the planet carrier and the upper cover.

10. The laundry treating appliance of claim 9 wherein the carrier washer damps or prevents contact between the planet carrier and the upper cover.

11. A laundry treating appliance, comprising:
- a tub defining an interior;
- a basket with a spin tube located within the interior and rotatably mounted within the tub;
- a motor having a first drive shaft;
- a clothes mover rotatably mounted within the basket and having a second drive shaft; and
- a clutch having a helical drive mechanism comprising:
  - a helical sun gear driven by the first drive shaft;
  - at least one helical planet gear driven by the helical sun gear;
  - a planet carrier driven by the at least one helical planet gear, the planet carrier selectively coupled to the second drive shaft to rotate the clothes mover; and
  - an outer helical ring gear driven by the at least one helical planet gear, the outer helical ring gear operably coupled to the spin tube to rotate the basket;
  - wherein meshes formed by teeth between at least one of the helical sun gear, the at least one helical planet gear, or the helical ring gear and at least another of the helical sun gear, the at least one helical planet gear, or the helical ring gear define a total contact ratio of an effective number of teeth in mesh at the same time that is greater than 3:1.

12. The laundry treating appliance of claim 11 wherein the meshes comprise the helical sun gear, the at least one helical planet gear, and the helical ring gear each defining a plurality of teeth that mesh with the teeth of the other gears.

13. The laundry treating appliance of claim 12 wherein the teeth of the helical sun gear, the at least one helical planet gear, and the helical ring gear are provided at an angle relative to an axis of rotation of the basket.

14. The laundry treating appliance of claim 13 wherein the total contact ratio is a function of the angle of the teeth of the helical sun gear, the at least one helical planet gear, or the helical ring gear relative to the axis of rotation.

15. The laundry treating appliance of claim 12 wherein the total contact ratio defines the effective number of teeth between any two of the helical sun gear, the at least one helical planet gears, or the helical ring gear that are in mesh at the same time, along both a face of the teeth and a transverse profile of the teeth.

16. The laundry treating appliance of claim 11 wherein the total contact ratio is the sum of a gear transverse contact ratio and an overlap ratio.

17. The laundry treating appliance of claim 16 wherein the gear transverse contact ratio of at least one of the helical sun gear and the at least one helical planet gear or the at least one helical planet gear and the helical ring gear is greater than or equal to 1.1:1.

18. The laundry treating appliance of claim 16 wherein the overlap ratio of at least one of the helical sun gear and the at least one helical planet gear or the at least one helical planet gears and the helical ring gear is greater than or equal to 2.0:1.

19. The laundry treating appliance of claim 11 wherein the helical drive mechanism reduces a sound power level during operation of the laundry treating appliance at a gear grinding frequency relative to a spur gear drive mechanism.

20. The laundry treating appliance of claim 11 wherein contacts between the helical sun gear, the at least one helical planet gear, or the helical ring gear have differing mesh phasing to reduce vibration within the helical drive mechanism.

* * * * *